US005178272A

United States Patent [19]

Evers

[11] Patent Number: 5,178,272

[45] Date of Patent: Jan. 12, 1993

[54] CIGARETTE PACK WITH PARTLY REMOVABLE INNERFRAME

[75] Inventor: Donald H. Evers, Richmond, Va.

[73] Assignee: Philip Morris Incorporated, New York, N.Y.

[21] Appl. No.: 766,050

[22] Filed: Sep. 26, 1991

Related U.S. Application Data

[63] Continuation-in-part of Ser. No. 576,776, Sep. 4, 1990, abandoned.

[51] Int. Cl.[5] ..... B65D 85/10

[52] U.S. Cl. ..... 206/264; 206/275; 229/87.05

[58] Field of Search ..... 206/264, 265, 268, 270, 206/271, 273, 275, 831; 229/87.05

[56] References Cited

U.S. PATENT DOCUMENTS

| | | |
|---|---|---|
| 348,924 | 9/1886 | Munson . |
| 476,765 | 6/1892 | Knapp . |
| 727,600 | 5/1903 | Doscher . |
| 1,116,043 | 11/1914 | Elliott . |
| 2,265,664 | 12/1941 | Markert . |
| 2,359,679 | 10/1944 | Roehrl . |
| 2,415,117 | 2/1947 | Tamarin . |
| 2,803,394 | 8/1957 | Ringler . |
| 2,824,684 | 2/1958 | Ahlers . |
| 2,889,100 | 6/1959 | Baker . |
| 3,018,878 | 1/1962 | Watkins . |
| 3,024,902 | 3/1962 | Taylor . |
| 3,062,430 | 11/1962 | Rutledge . |
| 3,102,675 | 9/1963 | Schrom . |
| 3,219,253 | 11/1965 | Davis . |
| 3,606,135 | 9/1971 | Rosenburg, Jr. . |
| 3,625,412 | 12/1971 | Rosenburg, Jr. . |
| 3,695,422 | 10/1972 | Tripodi . |
| 3,924,740 | 12/1975 | Wood . |
| 3,958,744 | 5/1976 | Herglotz . |
| 4,042,110 | 8/1977 | Guernsey . |
| 4,103,820 | 8/1978 | Mathison et al. . |
| 4,108,350 | 8/1978 | Forbes, Jr. . |
| 4,216,898 | 8/1980 | Davies . |
| 4,300,676 | 11/1981 | Focke et al. . |
| 4,303,155 | 12/1981 | Focke et al. . |
| 4,485,926 | 12/1984 | Lenzmeier . |
| 4,732,276 | 3/1988 | Knecht . |
| 4,742,955 | 5/1988 | Focke et al. . |
| 4,753,383 | 6/1988 | Focke et al. . |
| 4,753,384 | 6/1988 | Focke et al. . |
| 4,771,882 | 9/1988 | Lowe et al. . |
| 4,779,733 | 10/1988 | Kilian . |
| 4,834,240 | 5/1989 | Dagostine . |
| 4,850,482 | 7/1989 | Campbell . |
| 4,872,555 | 10/1989 | Shadrach, III et al. . |
| 4,942,961 | 7/1990 | Focke et al. . |
| 4,949,841 | 8/1990 | Focke et al. . |
| 5,014,906 | 5/1991 | Gero . |

FOREIGN PATENT DOCUMENTS

| | | |
|---|---|---|
| 1250553 | 2/1989 | Canada . |
| 2047860 | 4/1971 | Fed. Rep. of Germany . |
| 2551427 | 5/1977 | Fed. Rep. of Germany . |
| 2303720 | 10/1976 | France . |
| 3983 | 1/1916 | United Kingdom . |

OTHER PUBLICATIONS

Molins Machine Company Limited, *Molins Hinge Lid Pack*, 1965 England.

*Primary Examiner*—Bryon P. Gehman

*Attorney, Agent, or Firm*—Robert R. Jackson; Karen G. Horowitz

[57] ABSTRACT

A box-like cigarette pack has an innerframe which initially extends upward into what is normally a cutout in the front of the innerframe. This extension may then continue over the top of the cigarettes in the pack. The innerframe is weakened along the line which normally defines the cutout. When the consumer first opens the pack, he or she can remove the innerframe extension by tearing or separating along this line of weakening. Thereafter, the pack is like a normal pack. Additional information can be printed on the removable portion or portions of the innerframe. If provided, the portion which initially extends over the cigarette tops is a convenient size for use as a coupon or the like.

18 Claims, 3 Drawing Sheets

CIGARETTE PACK WITH PARTLY REMOVABLE INNERFRAME

This application is a continuation-in-part of patent application Ser. No. 576,776, filed on Sep. 4, 1990, now abandoned.

BACKGROUND OF THE INVENTION

This invention relates to cigarette packs, and more particularly to cigarette packs in the form of boxes.

Cigarette packs in the form of boxes are extremely well known. One of the most popular forms of such boxes has a cardboard outer member which includes a lower main portion in which the cigarettes stand vertically. The upper portion is a cardboard lid which is often (although not always) hinged to the back of the main portion so that the upper ends of the cigarettes are exposed when the lid is tipped back. Such boxes typically have a cardboard innerframe inside the main portion and which extends up from the main portion under the lid to provide some interference with the lid as it opens and closes. This interference helps to keep the lid firmly and neatly closed and reduces the risk that the lid will open accidentally. The cigarettes may be wrapped in aluminum foil inside the outer member and the innerframe.

Cigarette packs of the foregoing type are relatively small and strong. The visible exterior surfaces are needed for brand-identifying information, contents specifications, warning labels, etc. There is therefore no room on the outside of the pack for additional information such as promotional coupons, and even if such additional information could be put on the outside of the pack, it would be difficult for the consumer to free that information (such as a coupon) from the pack. Placing coupons or other information separately in the pack is disadvantageous because it necessitates additional processing steps and production equipment, because it may not be noticed by the consumer, etc.

It is therefore an object of this invention to provide a cigarette pack having additional surface areas which can be used for a coupon or other information.

It is another object of this invention to provide a cigarette pack including additional information area which cannot be overlooked by the consumer, but which can be easily removed and either saved or discarded as desired.

It is still another object of this invention to provide a cigarette pack having an additional but removable information area, which pack functions as a standard pack after the additional information area is removed.

SUMMARY OF THE INVENTION

These and other objects of the invention are accomplished in accordance with the principles of the invention by providing a box-like cardboard cigarette pack in which the cardboard innerframe (which may otherwise be substantially conventional) has an extension above the normal front cutout. This innerframe extension preferably (but not necessarily) continues up to and over the tops of the cigarettes in the box when the lid is first opened. (The cigarettes may be wrapped in foil inside the innerframe in the conventional manner.) The innerframe extension is joined to the remainder of the innerframe along a line which is deliberately weakened to facilitate removal of the extension by tearing or separating along this line. Any desired information can be printed anywhere on either or both sides of this extension. Because in general the consumer cannot conveniently withdraw the first cigarette until this extension (and any underlying foil) has been removed, the consumer cannot fail to see the information on the extension. Any portion of the extension which initially covers the upper ends of the cigarettes can be easily made rectangular, which is a convenient shape for a coupon. Alternatively, the "coupon" portion of the extension may have any of a wide variety of other shapes. A second (preferably stronger) line of weakness may be provided in the extension to facilitate separation of any "coupon" portion from the remainder of the extension. The extension or any portion of it makes an excellent coupon because it is relatively stiff innerframe cardboard.

Further features of the invention, its nature and various advantages will be more apparent from the accompanying drawings and the following detailed description of the preferred embodiments.

DETAILED DESCRIPTION OF THE PREFERRED EMBODIMENTS

Figure 1:
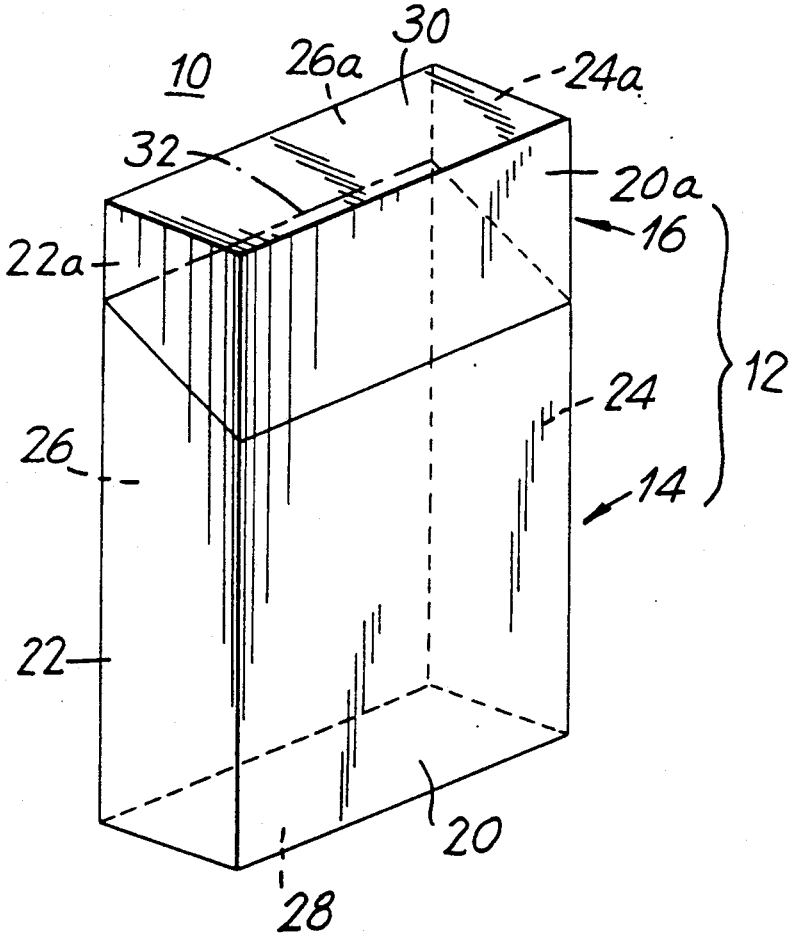
FIG. 1 is an isometric view of a cigarette pack of an illustrative type with which this invention can be employed.

As shown in FIG. 1, the conventional hinged-lid, box-type, crush-resistant cigarette pack 10 includes an outer member 12, formed of a substantially stiff material, such as 0.010–0.014 inch thick paperboard or cardboard. Outer member 12 has a lower main portion 14 and an upper lid portion 16. Main portion 14 has a front wall 20, a left side wall 22, a right side wall 24, a rear wall 26, and a bottom wall 28. Lid 16 has similar front **20*a*, left side 22*a*, right side 24*a*, and rear 26*a* walls which respectively function as continuations of the similarly named main portion walls when the lid is closed as shown in FIG. 1. In addition, lid 16 has a top wall 30. Lid 16 is typically hinged to main portion 14 along hinge line 32 where rear walls 26 and 26*a* meet one another. When lid 16 is tipped all the way back along hinge line 32, the pack has the appearance shown in FIG. 2 when viewed from the front, or as shown in FIG. 3** when viewed from the top.

Figure 2:
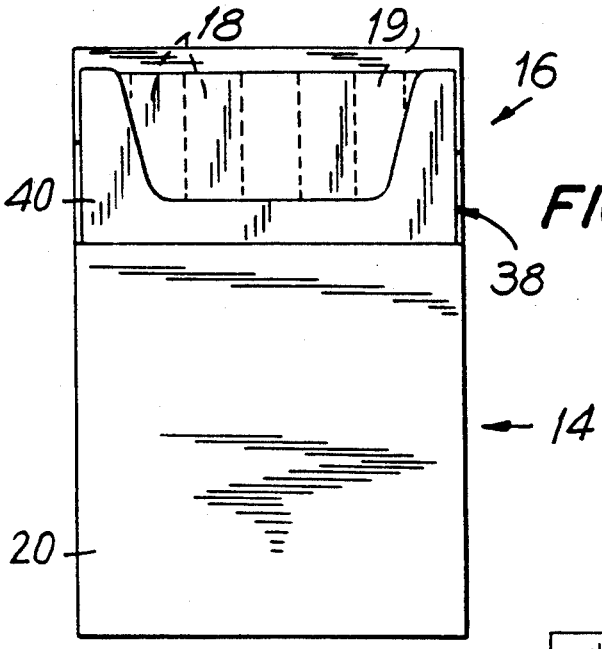
FIG. 2 is a front view of the pack of FIG. 1 with the top or lid pivoted back.
Figure 3:
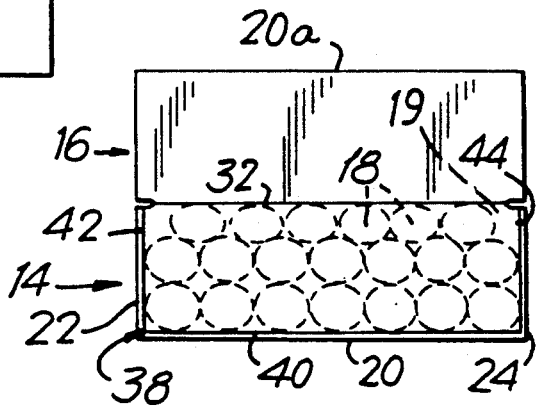
FIG. 3 is a top view of the pack of FIG. 1 with the top or lid pivoted back.

FIGS. 2 and 3 reveal the innerframe 38 which is conventionally included inside at least the upper portion of main portion 14. Innerframe 38 is formed of a substantially stiff material, such as 0.010–0.014 inch thick paperboard or cardboard. Innerframe 38 includes a front wall 40, a left side wall 42, and a right side wall 44. Innerframe 38 is positioned in contact with lower main portion 14, and is typically glued to lower main portion 14 to secure the innerframe in place. The central upper portion of innerframe front wall 40 has a depression or cutout to facilitate consumer access to the upper ends of the cigarettes 18 in the pack.

Typically, cigarettes 18 are wrapped in relatively thin and flexible metal (e.g., aluminum) foil 19 inside innerframe 38. Such a foil wrapper, when intact, serves to contain the cigarettes through the packing process, to protect the cigarettes, to provide an oil barrier between the cigarettes and the innerframe and outer member, and to retain moisture in the cigarettes. The upper front portion of this foil wrapper may be removed by the consumer when he or she opens the pack.

An upper portion of each of innerframe front wall 40, left side wall 42, and right side wall 44 projects above lower main portion 14 and remains unattached to any other portion of the cigarette pack outside the innerframe. When lid 16 is closed, it fits down over and completely covers the portion of innerframe 38 which projects above main portion 14, remaining adjacent yet unattached to the innerframe. Innerframe 38 interferes somewhat with lid 16 as the lid is opened and closed. This interference helps to keep lid 16 neatly closed and reduces the risk of the pack opening by accident. Retention cuts (not shown) known to the art, such as shown in U.S. Pat. No. 4,216,898, may also be included on innerframe 38 to provide additional interference.

Figure 4:
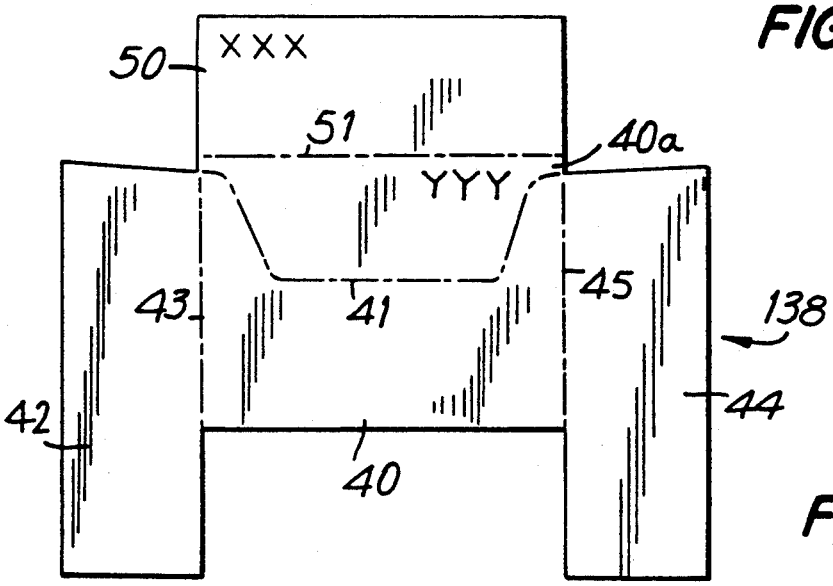
FIG. 4 is an illustrative innerframe blank configured in accordance with this invention.

An illustrative innerframe blank 138 in accordance with this invention is shown in FIG. 4. Similar reference numbers are used in FIGS. 4–6 for elements which are similar or related to innerframe elements described above. Innerframe blank 138, formed of a substantially stiff material such as described above for innerframe 38, includes a front wall panel 40 which is extended upwardly (above line 41) to include an extended front wall panel **40*a* and a top wall panel 50 (separated from panel 40*a* by line 51). Innerframe blank 138 also includes left wall panel 42 and right wall panel 44. To facilitate folding panels 42 and 44 back, the blank may be weakened (e.g., scored and/or perforated along lines 43 and 45). Blank 138 is also weakened (e.g., by extensive cuts or perforations) along line 41. As will be described in more detail below, this helps the consumer remove panels 40*a* and 50 when he or she first opens the pack. Blank 138 is also preferably weakened (e.g., scored or perforated) along line 51 at least to facilitate folding panel 50 back toward the rear of the pack over the top of the cigarettes as the pack is made up. In addition, this weakening along line 51 may be such as to facilitate consumer separation of panels 40*a* and 50 (e.g., so that a coupon or the like printed on panel 50 can be saved, while more irregularly shaped panel 40*a* is discarded). If only folding along line 51 is desired (e.g., because there is no "coupon" or because panels 40*a* and 50 together comprise the "coupon"), then the blank may be merely scored along that line. On the other hand, if panel separation along line 51 is desired, then cuts and/or perforations may be used along line 51. In any event, the weakening of blank 138 along line 51 is preferably less than the weakening along line 41 so that panels 40*a* and 50 tend to come out of the pack together. Thereafter, panels 40*a* and 50 can be separated along line 51** if desired.

Figure 5:
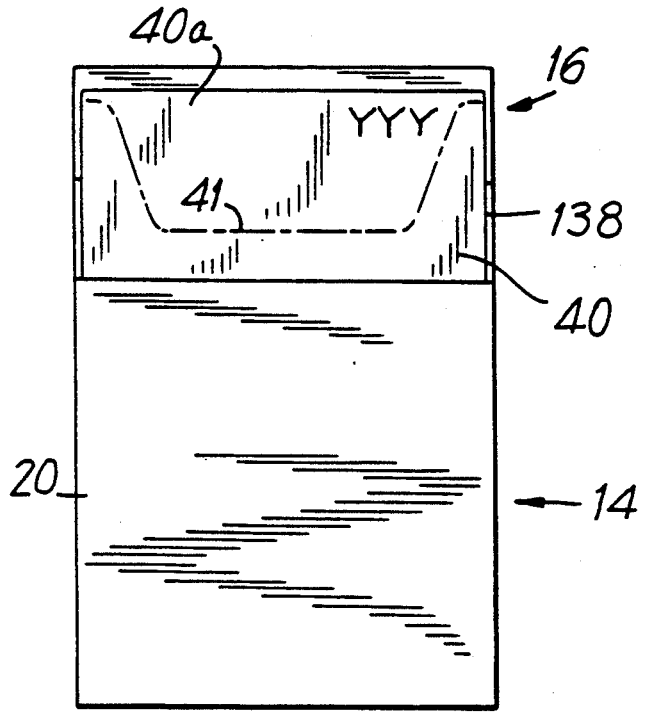
FIG. 5 is a view similar to FIG. 2 but showing a pack having an innerframe of the type shown in FIG. 4.
Figure 6:
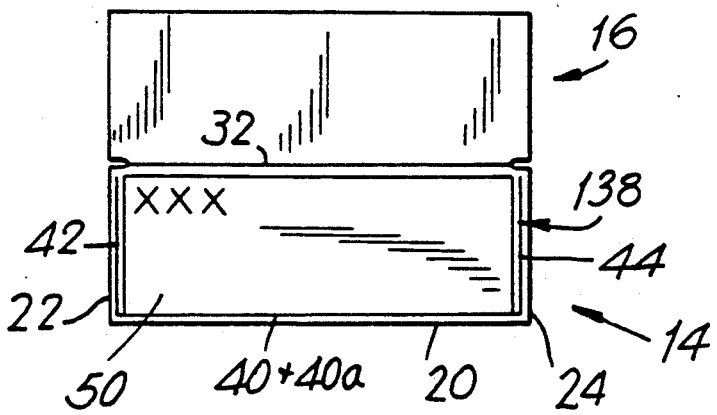
FIG. 6 is a view similar to FIG. 3 but showing a pack having an innerframe of the type shown in FIG. 4.

As suggested by the letters XXX and YYY in FIGS. 4–6, either or both of panels **40*a* and 50 may be printed on either or both sides with any desired information. For example, panel 50 may be printed with coupon or promotional information, while panel 40*a* may be printed with a suggestion that panel 50** be torn off and saved. The back side of any portion to be saved may be printed with required dealer copy. Printing may be placed on the innerframe at any time (e.g., before or after the innerframes are cut to their final individual shape). A special eye mark may be included in printing applied prior to cutting to help register the cutting with the printing.

It will be noted that the innerframe design shown in FIG. 4 permits continuous cutoff of innerframes from a roll of material with no scrap or waste.

FIGS. 5 and 6 are respectively similar to FIGS. 2 and 3, but show a cigarette pack with innerframe 138 prior to removal of panels **40*a* and 50. Except for the use of a differently shaped innerframe 138, the pack shown in FIGS. 5 and 6 may be exactly as described above in connection with FIGS. 1–3. In particular, the outer member of the pack shown in FIGS. 5 and 6 may be the same as the outer member 12 described above, and the cigarettes may be wrapped in foil inside the innerframe as described above. As can be seen in FIGS. 5 and 6, panels 40 and 40*a* are inside and/or extend up from front wall 20. Panels 42 and 44 are respectively inside and extend up from left and right side walls 22 and 24. Panel 50 extends over the top of the cigarettes in the pack (outside any inner foil wrapper around the cigarettes). Innerframe 138 is entirely outside any inner foil wrapper around the cigarettes. Innerframe 138 is typically immediately inside outer member components 14 and 16 and may be glued to the main portion 14 of the outer member. However, no portion of innerframe 138 above main portion 14 is attached in any way to any portion of the outer member (i.e., to lid portion 16). Panels 40*a* and 50 are also preferably free from any attachment to anything inside the innerframe such as any foil wrapped around the cigarettes. Innerframe 138 provides the same interference with the opening and closing of lid 16 as does innerframe 38**, as described above.

Although FIGS. 5 and 6 show the pack with top 16 open, it will be appreciated that the top opens and closes exactly as shown in FIGS. 1–3 and described above. As in the prior art, when the top of the pack shown in FIGS. 5 and 6 is closed, the outer member of the pack completely encloses and obscures innerframe 138 without lid 16 being attached to innerframe 138. Accordingly, when the pack shown in FIGS. 5 and 6 is closed, it looks exactly as shown in FIG. 1.

When the consumer of a pack having an innerframe of the type shown in FIG. 4 first opens the pack, he or she sees what is shown in FIGS. 5 and 6. In order to conveniently remove a cigarette from the pack, the consumer must first remove innerframe cardboard panels **40*a* and 50. This is both readily apparent to the consumer from, and facilitated by, the visible weakening along line 41. The printing on the innerframe may also suggest removal of these panels. After panels 40*a* and 50 have been removed, the pack looks exactly as shown in FIGS. 2 and 3 and is thereafter the same as a conventional pack. Also after removal from the pack, panels 40*a* and 50 can be separated from one another (e.g., so that panel 50 can be saved, while panel 40*a* is discarded as described above), or panels 40*a* and 50 may remain together for discard or retention as a unit. Because panels 40*a* and 50** are cardboard, they make an excellent coupon.

Although panel 50 is shown as a rectangle, it will be appreciated that it can have other shapes such as a scalloped edge, an oval, etc. Also, line 41 can be moved down from the location shown in the drawings to increase the size of panel **40*a* in the event that additional copy area is required. On the other hand, if less copy area is required, panel 50** can be eliminated entirely.

Although innerframe 138 is described as being suitable for containing additional printed information, because it more completely covers the upper ends of the cigarettes, it may be used as a dust cover, i.e., a substitute for foil wrapping of the cigarettes in the area covered by the innerframe.

It will be understood that the foregoing is merely illustrative of the principles of the invention, and that various modifications can be made by those skilled in the art without departing from the scope and spirit of the invention. For example, lid 16 may be either integral with main portion 14 or glued to main portion 14 by a tab. The lid of the pack may also slide on and off over the innerframe rather than pivoting open and closed. It will also be appreciated that the principles of this invention can be applied to cigarette packs of any size (e.g., packs of 10, 14, 20 (as shown in the drawings), 25, etc., cigarettes).

What is claimed is:

1. A cigarette pack comprising:

a substantially box shaped substantially stiff outer member having four vertical walls and a bottom wall, each of said walls having an inner face on the inside of the outer member and an outer face on the outside of the outer member, wherein said walls include an outer member front wall having a first vertical edge along the left side of the outer face thereof, a second vertical edge along the right side of the outer face thereof, a first top edge along the top thereof, and a first horizontal bottom edge along the bottom thereof; a rear wall substantially parallel to and spaced from said outer member front wall, said rear wall having a third vertical edge along the left side of the inner face thereof, a fourth vertical edge along the right side of the inner face thereof, and a second horizontal bottom edge; an outer member first side wall extending between said first and third vertical edges; an outer member second side wall extending between said second and fourth vertical edges; and a bottom wall extending between said first and second horizontal bottom edges, the height of said outer member front wall from said bottom wall to said first top edge being substantially less than the height of a cigarette;

an innerframe member of substantially the same stiffness as said outer member, said innerframe member positioned partly inside at least an upper portion of said outer member and having an innerframe front wall positioned adjacent said outer member front wall and having an inner face and an outer face wherein said outer face of said innerframe front wall is placed against said inner face of said outer member front wall, said innerframe front wall including a fifth vertical edge along the left side of the outer face thereof, a sixth vertical edge along the right side of the outer face thereof, a second top edge along the top thereof, and a third bottom edge along the bottom thereof, said third bottom edge being below said first top edge, and said innerframe front wall extending up from inside said outer member front wall so that said second top edge is above said first top edge; an innerframe first side wall extending from said fifth vertical edge toward said rear wall at least partly inside said outer member first side wall; and an innerframe second side wall extending from said sixth vertical edge toward said rear wall at least partly inside said outer member second side wall; said innerframe front wall being weakened along a line which is located below said second top edge so that, when said pack is opened, the portion of said innerframe front wall above said line can be easily torn out of the pack for complete removal from the pack, said portion of said innerframe front wall above said line being free from attachment to any part of said pack other than to the remainder of said innerframe member via said line; and a lid member which fits over the portion of said innerframe member projecting above said outer member and which closes said pack when said lid member is closed;

wherein said innerframe member is free from attachment to said lid member yet interferes with said lid member during opening and closing of said lid member.

2. The cigarette pack defined in claim 1 wherein said innerframe front wall is weakened along said line by being cut through along most but not all of said line.

3. The cigarette pack defined in claim 1 wherein said line extends substantially between said fifth and sixth vertical edges.

4. The cigarette pack defined in claim 3 wherein at said fifth and sixth vertical edges, said line is near said second top edge, but between said fifth and sixth vertical edges, said line drops down away from said second top edge to provide, when said portion of said innerframe front wall above said line is torn out, a cutout portion at the top of the remaining portion of the innerframe front wall which facilitates withdrawal of cigarettes from said pack.

5. The cigarette pack defined in claim 1 wherein said line is above said first top edge.

6. The cigarette pack defined in claim 1 wherein the distance from said bottom wall to said second top edge is substantially the length of a cigarette.

7. The cigarette pack defined in claim 6 wherein said innerframe member additionally has an innerframe top wall extending from said second top edge toward said rear wall.

8. The cigarette pack defined in claim 7 wherein said innerframe top wall overlies the upper ends of all of the cigarettes in the pack before said upper portion of said innerframe front wall above said line and said innerframe top wall are torn out.

9. The cigarette pack defined in claim 7 wherein at least one of said portion of said innerframe front wall above said line and said innerframe top wall is printed with predetermined indicia.

10. The cigarette pack defined in claim 7 wherein said innerframe member is additionally weakened along said second top edge to facilitate separation of said innerframe top wall from the portion of said innerframe front wall above said line.

11. The cigarette pack defined in claim 10 wherein said innerframe front wall is weakened to a greater extent along said line than said innerframe is weakened along said second top edge.

12. The cigarette pack defined in claim 1 wherein said portion of said innerframe front wall above said line is printed with predetermined indicia.

13. The cigarette pack defined in claim 1 wherein said lid member completely covers the portion of said innerframe member which projects above said outer member when said lid member is closed.

14. The cigarette pack defined in claim 1 wherein said lid member is hinged to said rear wall.

15. The cigarette pack defined in claim 1 wherein said outer member, said innerframe, and said lid member are all formed from paperboard.

16. The cigarette pack defined in claim 15 wherein said paperboard is between 0.010 inches and 0.014 inches thick.

17. The cigarette pack defined in claim 1 further comprising:

a metal foil wrapper substantially surrounding the cigarettes and disposed inside said innerframe member, said wrapper being relatively thin and relatively flexible as compared to said outer member and said innerframe member.

18. The cigarette pack defined in claim 1 wherein said innerframe is positioned within said outer member such that the portion of said innerframe inside said outer member remains stationary with respect to said outer member.

* * * * *